US007893627B2

(12) United States Patent
Li

(10) Patent No.: US 7,893,627 B2
(45) Date of Patent: Feb. 22, 2011

(54) LIGHT STRANDS

(76) Inventor: Xu-Liang Li, Kingsun Group Co., Ltd., Hengjiangxia Administration Zone, Changping Town, Dongguang (CN) 523565

( * ) Notice: Subject to any disclaimer, the term of this patent is extended or adjusted under 35 U.S.C. 154(b) by 463 days.

(21) Appl. No.: 12/045,628

(22) Filed: Mar. 10, 2008

(65) Prior Publication Data

US 2008/0310163 A1 Dec. 18, 2008

(51) Int. Cl.
*H05B 37/00* (2006.01)

(52) U.S. Cl. ..... 315/185 R; 315/185 S; 315/312; 362/251

(58) Field of Classification Search ..... 315/122, 315/185 S, 185 R, 200 R, 312; 362/221, 362/225, 227, 251, 252, 376, 806
See application file for complete search history.

(56) References Cited

U.S. PATENT DOCUMENTS 4,223,248 A * 9/1980 Tong ..... 315/185 S
4,227,228 A * 10/1980 Cheng ..... 361/104
5,726,535 A * 3/1998 Yan ..... 315/185 R
6,157,139 A * 12/2000 Gibboney, Jr. ..... 315/185 S
6,533,437 B1 * 3/2003 Ahroni ..... 362/249.14
6,853,151 B2 * 2/2005 Leong et al. ..... 315/185 R
6,855,448 B2 * 2/2005 Kikuchi et al. ..... 429/454
2005/0024877 A1 * 2/2005 Frederick ..... 362/277
2007/0164683 A1 * 7/2007 Allen ..... 315/200 R

* cited by examiner

*Primary Examiner*—Douglas W Owens
*Assistant Examiner*—Tung X Le

(57) ABSTRACT

The Light strands include at least two light strands connected in series. Each light strand includes a plurality of LED (Light Emitting Diode) lights connected in series, a plurality of two-hole light sockets and a pair of three-hole light sockets being configured for respectively accommodating the plurality of LED lights, a plug electrically connected to the pair of three-hole light sockets via electrical wires; a plug receptacle electrically connected to the pair of three-hole light sockets via electrical wires; and a current limiting device connected in series to the plurality of LED lights. The plurality of two-hole light sockets is disposed between the pair of three-hole light sockets and the plurality of two-hole light sockets and the pair of three-hole light sockets are connected in series. The current limiting device switches off the light strand due to over current.

12 Claims, 6 Drawing Sheets

LIGHT STRANDS

CROSS REFERENCE TO RELATED PATENT APPLICATION

This application claims the priority of the Chinese patent application No. 200720120774.3 with filing date of Jun. 18, 2007, which application is incorporated herein by reference.

BACKGROUND OF THE INVENTION

1. Technical Field

The present invention relates to decorative light strands, and more particularly, to light strands including a plurality of light strands connected in series.

2. Description of the Related Art

Decorative light strands are often used during holidays such as Christmas for decorating trees, shrubbery and both the interior and exterior of buildings. Conventional light strands are formed by connecting a plurality of light strands in series. However, the number of serially connected light strands is generally limited to a relatively small number such as three by the current flowing through the light strands during operation. Beyond such limit, the light strands may suffer from over current and consequently LED lights in the light strands may be damaged. In addition, when one of the LED lights in the conventional light strands is broken and stops working, all the other LED lights connected in series with the broken LED light in the light strands cannot work.

Therefore, what is needed is to provide light strands that are safe to use and well protected from being damaged by over current.

SUMMARY OF THE INVENTION

The Light strands include at least two light strands connected in series. Each light strand includes a plurality of LED lights connected in series, a plurality of two-hole light sockets and a pair of three-hole light sockets being configured for respectively accommodating the plurality of LED lights, a plug electrically connected to the pair of three-hole light sockets via electrical wires; a plug receptacle electrically connected to the pair of three-hole light sockets via electrical wires; and a current limiting device connected in series to the plurality of LED lights. The plurality of two-hole light sockets is disposed between the pair of three-hole light sockets and the plurality of two-hole light sockets and the pair of three-hole light sockets are connected in series. The current limiting device switches off the light strand due to over current.

In the embodiments of the present invention, further, each two-hole light socket includes a soft core fixed to each LED light, a soft shell, a bottom plug, and a conductive compression spring, and the soft shell accommodates the soft core, the bottom plug, and the conductive compression spring therein.

It is therefore an object of the present invention to provide light strands that are able to connect in series other light strands more freely and safe to use.

It is a further object of the present invention to provide light strands that are able to prevent one of the light strands therein switching off when one of LED lights of the light strands falls off.

Other advantages and novel features will become more apparent from the following detailed description of embodiments when taken in conjunction with the accompanying drawings.

BRIEF DESCRIPTION OF THE DRAWINGS

Many aspects of the present light strands can be better understood with reference to the following drawings. The components in the drawings are not necessarily drawn to scale, the emphasis instead being placed upon clearly illustrating the principles of the present light strands.

DETAILED DESCRIPTION OF THE INVENTION

Figure 1:
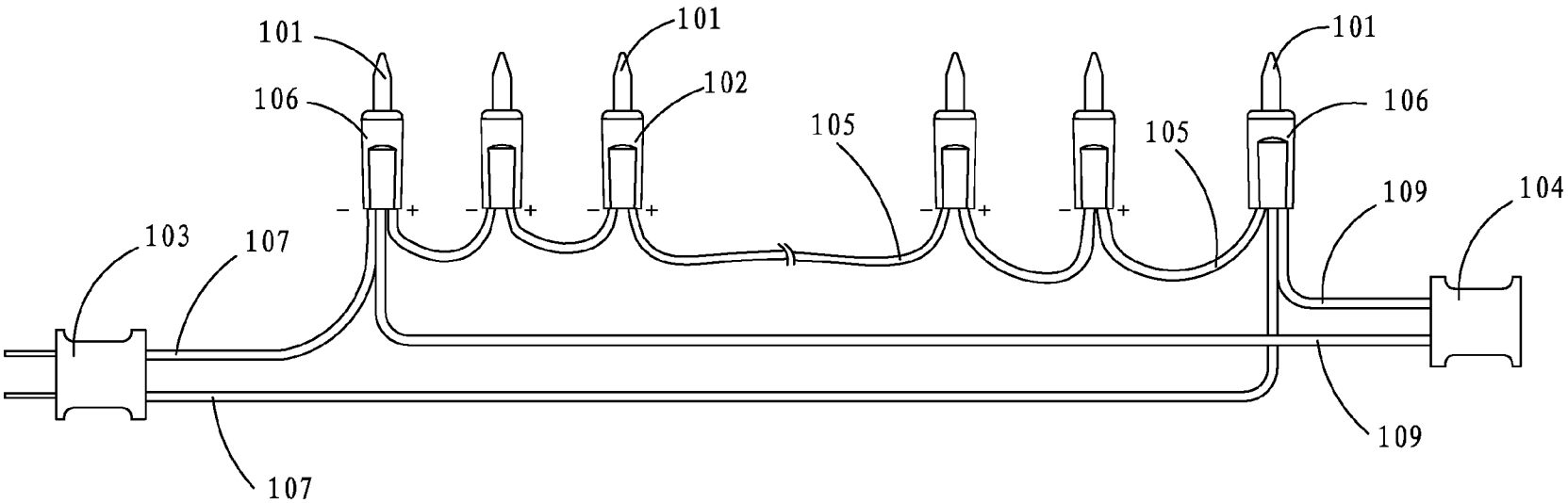
FIG. 1 is a schematic view of one of the light strands in accordance with a first embodiment of the present invention.

Light strands in accordance with a first embodiment of the present invention includes a plurality of light strands connected in series one another. Referring to FIG. 1, a light strand includes a plurality of LED (Light Emitting Diode) lights 101, a plurality of two-hole light sockets 102, a plug 103, a plug receptacle 104, and a pair of three-hole light sockets 106 respectively disposed at the two distal ends thereof. The plurality of two-hole light sockets 102 and the pair of three-hole light sockets 106 respectively accommodates the corresponding LED lights 101. The plurality of two-hole light sockets 102 are connected in series by electrical wires 105 extending from holes thereof. The plurality of LED lights 101 are connected in series by connecting the two-hole light sockets 102 and the pair of three-hole light sockets 106 via the electrical wires 105. The pair of three-hole light sockets 106 is respectively coupled to the plug 103 via two electrical wires 107. As such, the pair of three-hole light sockets 106 is also coupled to the plug receptacle 104 via two electrical wires 109, respectively. Two light strands are connected by the plug of one light strand being inserted in the plug receptacle of the other light strand. Similarly, many light strands may be thus coupled to one another.

Figure 2:
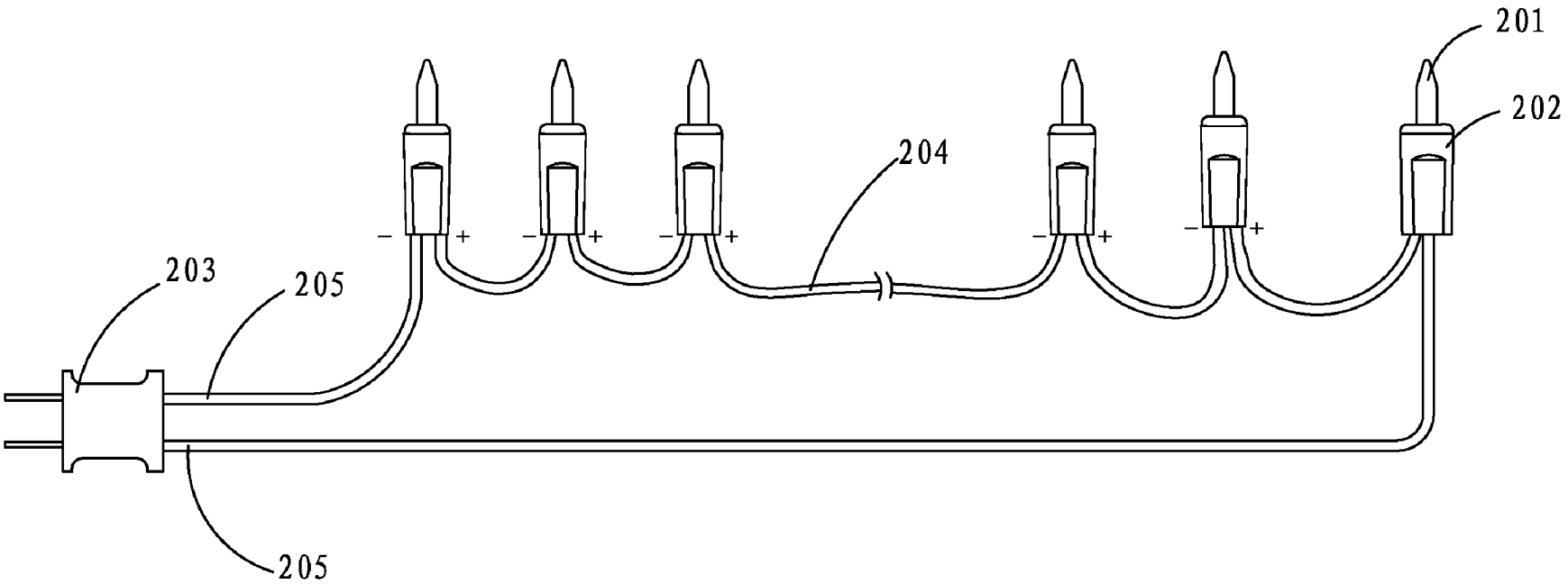
FIG. 2 is a schematic view of a tail-end light strand of the light strands in accordance with the first embodiment of the present invention.

FIG. 2 shows a tail-end light strand of the light strands in accordance with the first embodiment of the present invention. The tail-end light strand is disposed at the end of the whole light strands, and includes a plurality of LED lights 201, a plurality of two-hole light sockets 202, and a plug 203. The plurality of LED lights 201 are connected in series by connecting the two-hole light sockets 202 via electrical wires 204. The plug 203 is coupled to the pair of two-hole light sockets 202 at two opposite ends of the tail-end light strand via two electrical wires 205.

Figure 3:
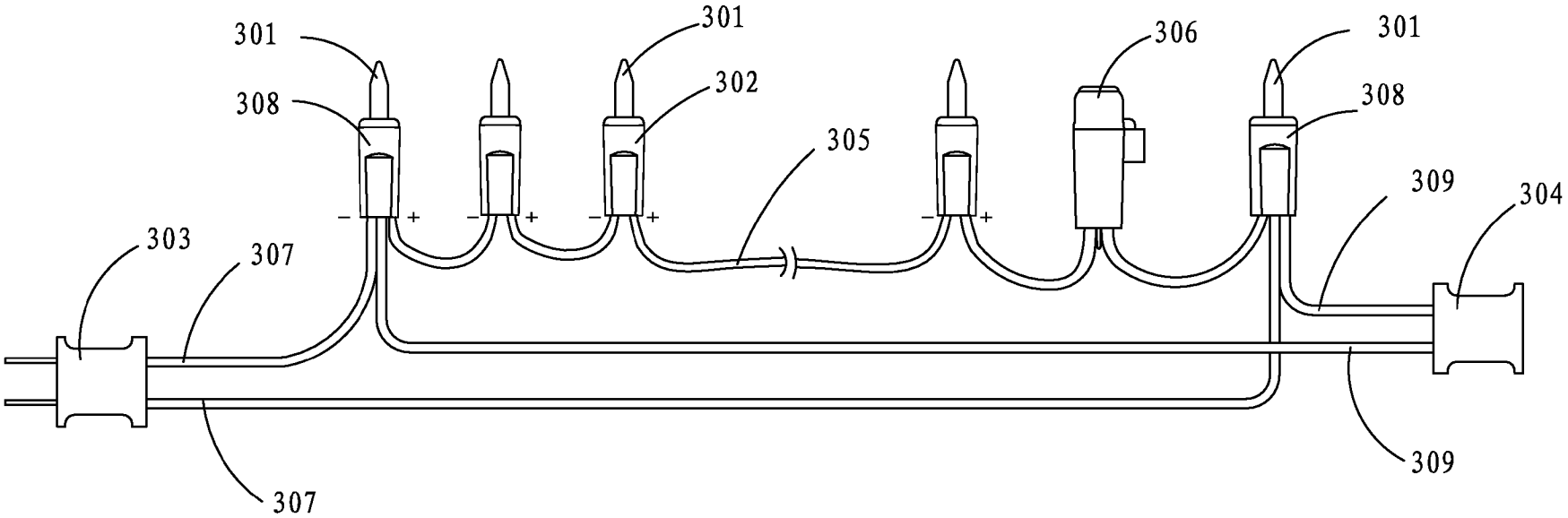
FIG. 3 is a schematic view of one of the light strands in accordance with a second embodiment of the present invention.

FIG. 3 shows a light strand in accordance with a second embodiment of the present invention. The light strand is similar to the light strand of the first embodiment of the present invention in FIG. 1, including a plurality of LED lights 301, a plurality of two-hole light sockets 302, a plug 303, a plug receptacle 304, a current limiting devices 306, a pair of three-hole light sockets 308 respectively disposed at the two distal ends thereof. The plurality of two-hole light sockets 302 and the pair of three-hole light sockets 308 respectively accommodates the plurality of LED lights 301 therein. The plurality of two-hole light sockets 302 are connected in series via electrical wires 305 extending from holes thereof. The plurality of LED lights 301 are connected in series by connecting electrodes of the LED lights 301 with the electrical wires 305. The current limiting device 306 is connected in series between any two adjacent two-hole light sockets 302 or between the three-hole light sockets 308 and the two-hole light sockets 302 adjacent to the three-hole light sockets 308. In this embodiment, the current limiting device 306 is connected in series between one of the two-hole light sockets 302 and one of the three-hole light sockets 308. The plug 303 is coupled to the pair of three-hole light sockets 308 via two electrical wires 307. As such, the plug receptacle 304 is also coupled to the pair of three-hole light sockets 308 via two electrical wires 309.

Figure 4:
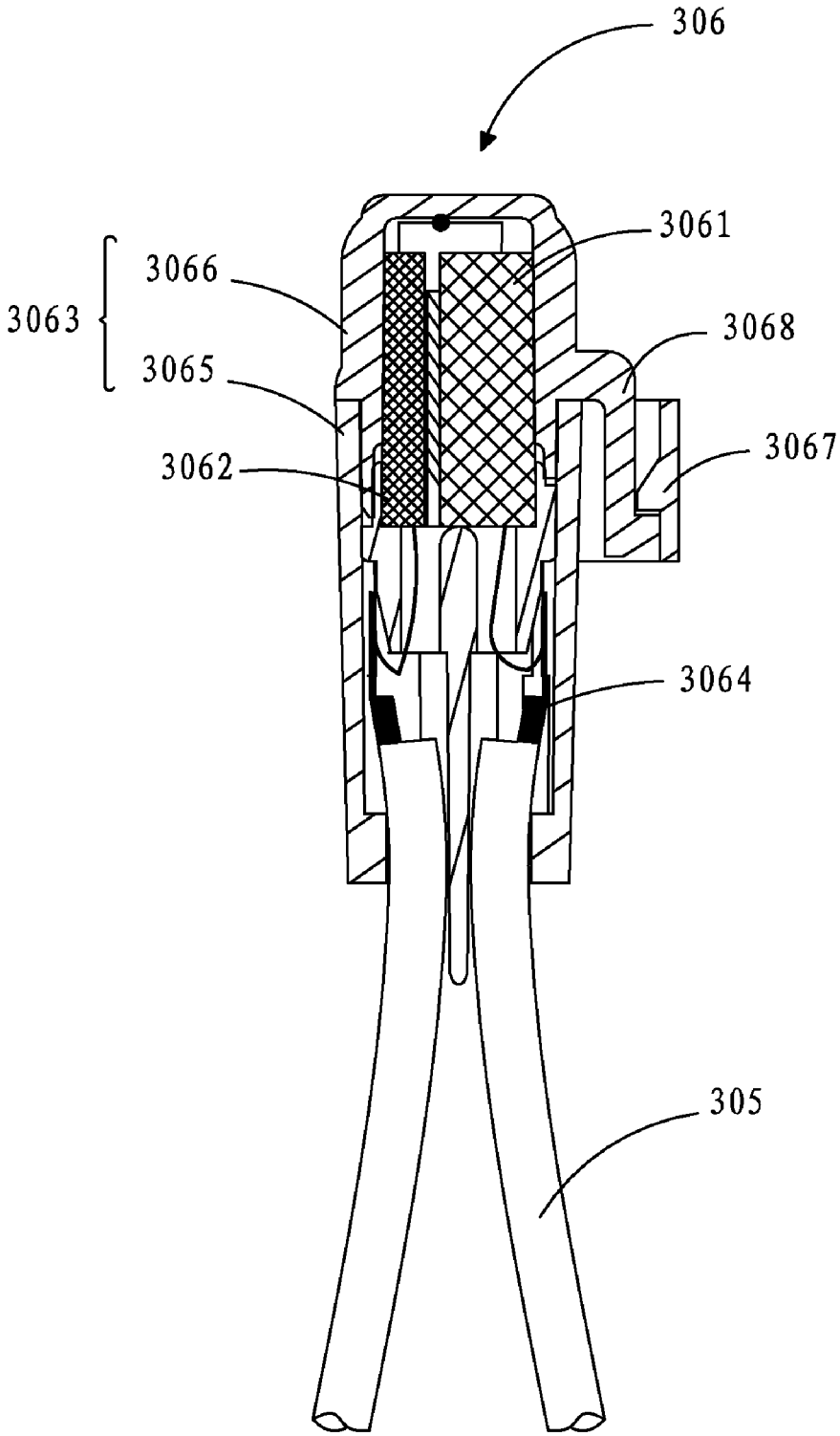
FIG. 4 is a sectional view of a current limiting device of the light strand of FIG. 3.

Also referring to FIG. 4, the current limiting device 306 includes a resistor 3061, a temperature fuse component 3062, an insulating inner core (not labeled) defining two pin holes through which two pins of the resistor 3061 are passed, and a housing 3063 for accommodating the resistor 3061 therein, the insulating inner core, and the temperature fuse component 3062 therein. The housing 3063 includes two connection terminals 3064 extending from a bottom thereof. The resistor 3061 and the temperature fuse component 3062 are electrically connected in series between the two connection terminals 3064. The two connection terminals 3064 are connected the two-hole light sockets 302 and/or the three-hole light sockets 308 via the electrical wires 305. The housing 3063 includes a cylindrically shaped main body 3065 and a cover 3066. The main body 3065 has a catch portion 3067 extending therefrom and the cover 3066 has a hook portion 3068 engaged with the catch portion 3067 in order that the main body 3065 and the cover 3066 can be firmly secured together.

Because the LED lights 301 have lower working current than conventional lights, thus, it is more free to connect in series a plurality of light strands in the original light strand. If one of the light strands generates over current and reaches a predetermined temperature, the current limiting device 306 of the light strand switches off the light strand in which the current limiting device 306 is located to thereby protect other light strands. Thus, the whole light strands can work on even though one of the light strands is broken due to over current.

Figure 5:
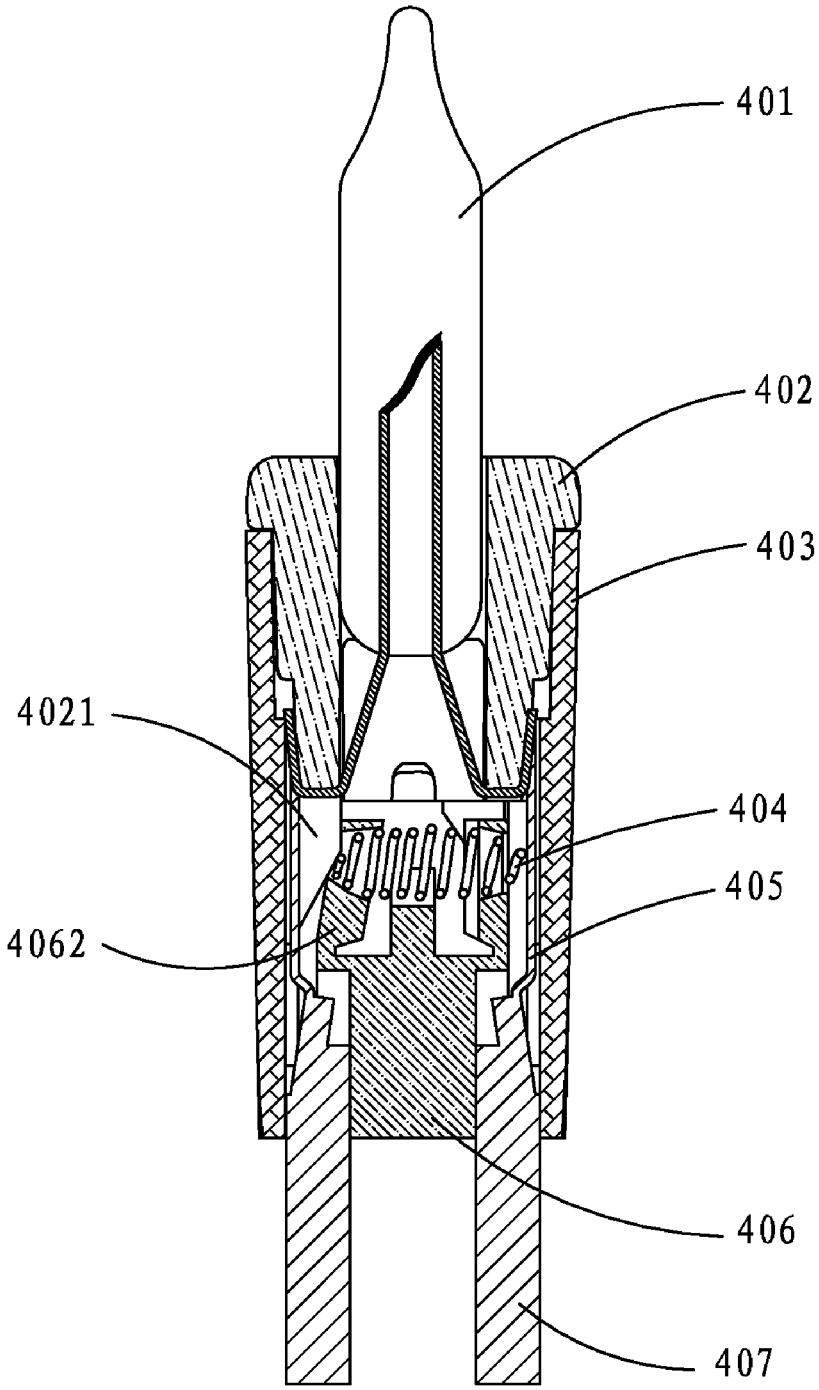
FIG. 5 is a sectional view of an LED light and a corresponding light socket of a light strand in accordance with a third embodiment of the present invention.
Figure 6:
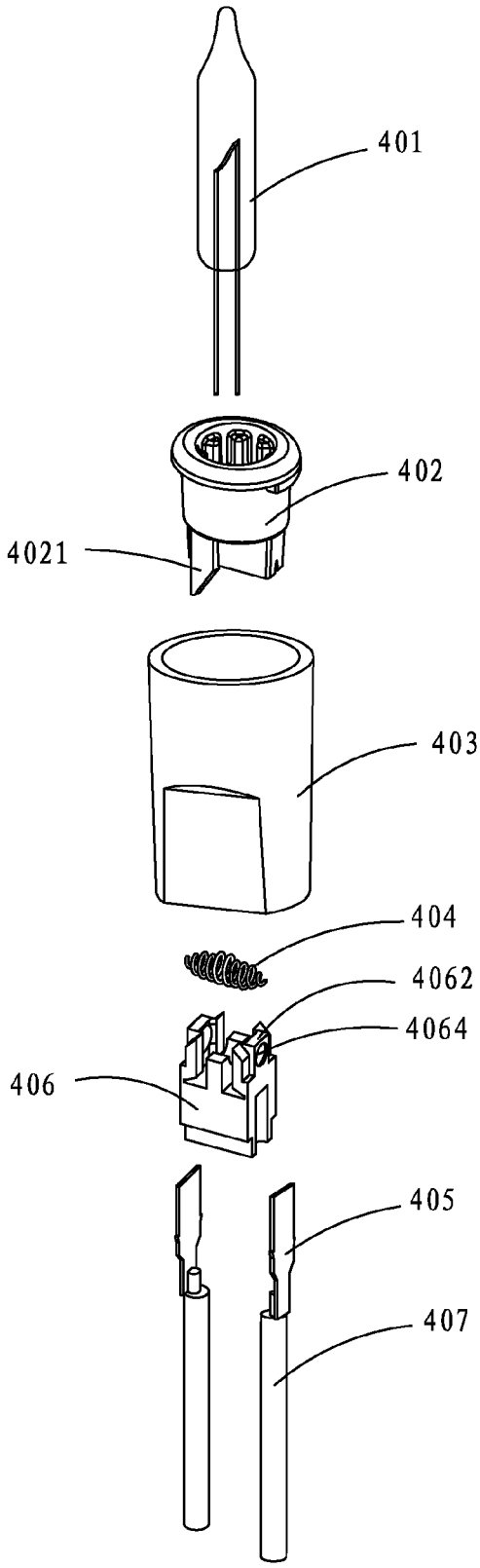
FIG. 6 is an exploded view of FIG. 5.

Light strands in accordance with a third embodiment of the present invention is similar to light strands in accordance with the first embodiment, and also includes a plurality of light strands connected in series one another. The difference between the third embodiment and the first embodiment lies in a two-hole light socket. Referring to FIG. 5 and FIG. 6, the two-hole light socket in accordance with the third embodiment of the present invention can prevent open circuit due to disengagement of an LED light. The two-hole light socket includes a soft core 402 fixed to an LED light 401, a soft shell 403 for accommodating the soft core 402, a bottom plug 406, and a compression spring 404. Two connection terminals 405 of two electrical wires 407 are respectively connected to two electrodes of the LED light 401, and the bottom plug 406 is positioned between the two connection terminals 405. The soft core 402, the soft shell 403, and the bottom plug 406 are made of insulating materials, for example, ABS (Acrylonitrile Butadiene Styrene). The soft core 402 is formed to have a wedge-shaped protrusion 4021 extending longitudinally from a bottom thereof and abutting against the left connection terminal 405 of the left electrical wire 407. The compression spring 404 is olive-shaped, and made of conducting materials such as metal. The bottom plug 406 includes two opposite blocks 4062 which respectively define a trapezoidal through hole 4064 therein for accommodating left and right ends of the olive-shaped compression spring 404. The left and right ends of the olive-shaped compression spring 404 respectively abut against a bevel face of the protrusion 4021 and the right connection terminals 405.

If the LED light 401 falls off, the soft core 402 is also compelled to fall off. When the soft core 402 disengages from the soft shell 403, the protrusion 4021 disengages from the left end of the compression spring 404 to cause the compression spring 404 to extend horizontally. As a result, the left end of the compression spring 404 abuts against the left connection terminals 405. The two connection terminals 405 of the two electrical wires 407 are electrically connected together via the conductive compression spring 404. Therefore, even though one of the LED lights in the light strand disengages from the two-hole light socket, the other LED lights in the light strand keeps on working. Thus, maintenance frequency may be dramatically decreased, and many light strands are conveniently and easily connected in series.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the present invention.

What is claimed is:

1. Light strands comprising at least two light strands connected in series, each light strand comprising:

a plurality of two-hole light sockets and a pair of three-hole light sockets being configured for respectively accommodating the plurality of LED lights, wherein the plurality of two-hole light sockets is disposed between the pair of three-hole light sockets, and the plurality of two-hole light sockets and the pair of three-hole light sockets are connected in series;

a plurality of LED lights connected in series by connecting the two-hole light sockets;

a plug electrically connected to the pair of three-hole light sockets via electrical wires;

a plug receptacle electrically connected to the pair of three-hole light sockets via electrical wires; and a current limiting device connected in series to the plurality of LED lights, the current limiting device being configured for switching off the light strand when the current flowing through the current limiting device is greater than a predetermined value, wherein each two-hole light socket comprises a soft core integratedly fixed to each LED light, a soft shell, a bottom plug, and a conductive compression spring, and the soft shell accommodates the soft core, the bottom plug, and the conductive compression spring therein; wherein the soft core is formed to have a wedge-shaped protrusion for compressing the conductive compression spring; and wherein the bottom plug includes two opposite blocks which respectively define a trapezoidal through hole therein for extension of the conductive compression spring therethrough.

2. The light strands according to claim 1, wherein the current limiting device comprises a resistor, a temperature fuse component, and a housing for accommodating the resistor and the temperature fuse component, the housing comprises two connection terminals extending from a bottom thereof, the resistor and the temperature fuse component are electrically connected in series between the two connection terminals, and the two connection terminals are respectively connected to the two-hole light sockets and the three-hole light sockets.

3. The light strands according to claim 2, wherein the housing comprises a main body and a cover, the main body has a catch portion extending therefrom and the cover has a hook portion engaged with the catch portion to thereby secure the cover to the main body firmly.

4. The light strands according to claim 1, wherein the soft core, the soft shell, and the bottom plug are made of insulating materials.

5. The light strands according to claim 1, further comprising a tail-end light strand disposed at the end of the light strands and connected in series with the light strands.

6. The light strands according to claim 5, wherein the tail-end light strand comprises a plurality of LED lights, a plurality of two-hole light sockets, and a plug.

7. A light strand comprising:

a plurality of two-hole light sockets and a pair of three-hole light sockets being configured for respectively accommodating the plurality of LED lights, the plurality of two-hole light sockets and the pair of three-hole light sockets being connected in series, wherein the plurality of two-hole light sockets is disposed between the pair of three-hole light sockets, and each two-hole light socket comprises a soft core integratedly fixed to each LED light, a soft shell, a bottom plug, and a conductive compression spring, and the soft shell accommodates the soft core, the bottom plug, and the conductive compression spring therein;

a plurality of LED lights connected in series by connecting the two-hole light sockets;

a plug electrically connected to the pair of three-hole light sockets via electrical wires; and a plug receptacle electrically connected to the pair of three-hole light sockets via electrical wires, wherein the bottom plug includes two opposite blocks which respectively define a trapezoidal through hole therein for extension of the conductive compression spring therethrough.

8. The light strand according to claim 7, wherein the soft core is formed to have a wedge-shaped protrusion for compressing the conductive compression spring.

9. The light strand according to claim 7, wherein the soft core, the soft shell, and the bottom plug are made of insulating materials.

10. The light strand according to claim 7, further comprising a current limiting device connected in series to the plurality of LED lights for switching off the light strand due to over current.

11. The light strand according to claim 10, wherein the current limiting device comprises a resistor, a temperature fuse component, and a housing for accommodating the resistor and the temperature fuse component, the housing comprises two connection terminals extending from a bottom thereof, the resistor and the temperature fuse component are electrically connected in series between the two connection terminals, and the two connection terminals are respectively connected to the two-hole light sockets and the three-hole light sockets.

12. The light strand according to claim 11, wherein the housing comprises a main body and a cover, the main body has a catch portion extending therefrom and the cover has a hook portion engaged with the catch portion to thereby secure the cover to the main body firmly.

* * * * *